US008079293B2

(12) United States Patent
Kortuem et al.

(10) Patent No.: US 8,079,293 B2
(45) Date of Patent: Dec. 20, 2011

(54) PERFORATION MACHINE FOR MANUFACTURING ADJUSTABLE VENT BAFFLES

(75) Inventors: Matt Kortuem, Blandon, PA (US); Palle Rye, Shillington, PA (US); Dave Rosten, Cambridge, MN (US); Richard L. Partlow, Jr., Reading, PA (US)

(73) Assignee: Brentwood Industries, Inc., Reading, PA (US)

( * ) Notice: Subject to any disclaimer, the term of this patent is extended or adjusted under 35 U.S.C. 154(b) by 589 days.

(21) Appl. No.: 11/842,596

(22) Filed: Aug. 21, 2007

(65) Prior Publication Data

US 2008/0041212 A1 Feb. 21, 2008

Related U.S. Application Data

(60) Division of application No. 11/263,735, filed on Nov. 1, 2005, now abandoned, which is a continuation-in-part of application No. 10/811,632, filed on Mar. 29, 2004, now Pat. No. 7,094,145.

(51) Int. Cl.
*B26D 7/06* (2006.01)

(52) U.S. Cl. ..... 83/155; 83/401; 83/469; 83/659; 83/678; 225/2

(58) Field of Classification Search ..... 225/93, 225/94, 96, 103, 1–5; 83/678, 875, 876, 83/878, 39, 151, 155, 882–887, 879, 880, 83/155.1, 284, 401, 709, 731, 409.2, 425, 83/469, 509, 658, 659

See application file for complete search history.

(56) References Cited

U.S. PATENT DOCUMENTS

| | | | | |
|---|---|---|---|---|
| 2,047,472 | A * | 7/1936 | Hotchkiss | 493/365 |
| 2,112,988 | A * | 4/1938 | Goodale et al. | 83/100 |
| 3,509,788 | A * | 5/1970 | Glendening | 83/114 |
| 3,863,553 | A | 2/1975 | Koontz | |
| 3,869,950 | A * | 3/1975 | Serra | 83/341 |
| 4,096,790 | A | 6/1978 | Curran | |
| 4,189,878 | A | 2/1980 | Fitzgerald | |
| 4,214,510 | A | 7/1980 | Ward | |
| 4,223,489 | A | 9/1980 | Bently | |
| 4,265,060 | A | 5/1981 | Woodhams | |
| 4,581,861 | A | 4/1986 | Eury | |
| 4,660,463 | A | 4/1987 | Bottomore et al. | |
| 5,007,216 | A | 4/1991 | Pearson | |
| 5,238,450 | A | 8/1993 | Rotter | |
| 5,341,612 | A | 8/1994 | Robbins | |
| 5,596,847 | A | 1/1997 | Stephenson | |

(Continued)

FOREIGN PATENT DOCUMENTS

JP 1993-039124 * 2/1993

*Primary Examiner* — Phong Nguyen
(74) *Attorney, Agent, or Firm* — Miller Law Group, PLLC

(57) ABSTRACT

A perforating machine for perforating a plurality of perforation lines in a vent baffle sheet comprises a support table having two spaced apart openings, perforating wheels, two backstop wheels, and an endless feed belt having a plurality of protrusions. The perforating wheels and the two backstop wheels are positioned on opposite side of the support table. The perforating wheels engage with the two backstop wheels through the two spaced apart openings. The endless feed belt has an upper portion and a lower portion. The lower portion of the endless feed belt is positioned above the support table. The protrusions on the lower portion of the endless feed belt engage with side stiffeners of the vent baffle sheet to move the sheet through the perforating wheels.

1 Claim, 12 Drawing Sheets

U.S. PATENT DOCUMENTS 5,600,928 A 2/1997 Hess et al.
5,697,842 A 12/1997 Donnelly
5,775,190 A * 7/1998 Terai ..... 83/92
6,346,040 B1 2/2002 Best
6,357,185 B1 3/2002 Obermeyer et al.
2005/0215192 A1 9/2005 Rye et al.

* cited by examiner

PERFORATION MACHINE FOR MANUFACTURING ADJUSTABLE VENT BAFFLES

CROSS-REFERENCE TO RELATED APPLICATIONS

This application is a division of U. S. patent application Ser. No. 11/263,735, filed Nov. 1, 2005, now abandoned entitled "Vent Baffle and Perforation Machine", which is a continuation-in-part of U. S. patent application Ser. No. 10/811,632, filed Mar. 29, 2004, now U. S. Pat. No. 7,094,145, granted on Aug. 22, 2006, the contents of which are incorporated herein by reference.

BACKGROUND OF THE INVENTION

The invention is in the field of building construction materials and particularly relates to attic vent baffles commonly used in residential building structures to allow ventilation flow through soffit vents into an attic space.

It is known to provide attic ventilation systems to properly ventilate the attic space often found in buildings. Ventilation of the attic space is desirable to help prevent formation of condensation along the interior surface of the roof, which can damage attic insulation and the building structure itself. Proper ventilation also helps to prevent premature melting of snow accumulated on a building roof. Such premature melting can lead to the formation of ice on the roof. Such ice formations can be both a safety hazard and can lead to roof damage.

Known attic ventilation systems typically comprise a plurality of vents located in the underside, or soffit, of eaves extending from the building roof. Typically, air travels through the soffit vents into the attic space via an opening (herein referred to as the "roof-wall plate opening") between the underside of the roof deck and the top of the exterior wall of the building (the so-called "wall plate") and subsequently through an air flow channel formed by a vent baffle disposed adjacent the underside of the roof deck. Ventilation flow typically exits from the air flow channel into the attic space. The attic space may be provided with a separate roof vent to facilitate flow of air from the attic space to the outdoors.

An attic ventilation system directs and controls the ventilation air flow, as otherwise uncontrolled air currents can be sufficiently strong to disturb placement of attic insulation, blowing the insulation about to create areas which are not properly insulated. Uncontrolled air currents circulating in the attic space can also negatively affect performance of the attic insulation by promoting increased convective heat transfer along the top surface of the insulation.

An attic ventilation system also accommodates installation of attic insulation over the entire ceiling, as nearly as possible up to the roof-wall plate opening. To do this, ventilation systems preferably make some provision to block intrusion of insulation into the interior space of the eaves (such intrusion could lead to blockage of the soffit vents) while also providing an air flow channel to permit and control air flow through the soffit vents into the attic space.

U.S. Pat. No. 6,357,185 (Obermeyer) describes a known attic ventilation system and includes a rafter air infiltration block used in conjunction with a conventional roof vent board. The block of Obermeyer is a generally rectangular sheet of material having a plurality of tabs connected to a remainder of the sheet by a plurality of fold lines. The block of Obermeyer serves to prevent intrusion of insulation disposed proximate the roof-wall plate opening into the eave interior space, while the roof vent board provides an air flow channel to allow and control air flow from the soffit vents into the attic space. Installation of a roof ventilation system in accordance with the invention of Obermeyer requires installation of a roof vent board, as well as separate installation of the separate block component. Installation of the block component of Obermeyer requires the installer to fold the block component along multiple fold lines. The installation process is thereby complicated by the need to install two separate components and also by the need to fold the block component along multiple fold lines.

U.S. Pat. No. 6,346,040 (Best) discloses a ventilation panel comprising a rectangular sheet divided by a plurality of fold lines into a rectangular central portion, a pair of side edge portions and an end portion. When the side edge portions and end portions are folded into place, the ventilation panel of Best forms both an airflow channel and a roof-wall plate opening block. In order to install the ventilation panel of Best, it is necessary that the sheet be cut and folded at multiple locations, thus necessitating a relatively complicated and time-consuming installation process.

U.S. Pat. No. 4,581,861 (Eury) discloses a baffle board having side tabs and an end tab, each of the tabs being connected to a remainder of the baffle board by either perforated lines or score lines along which the tabs are bent relative to the remainder of the baffle board. Similar to the ventilation panel of Best, when the baffle board of Eury is folded into an installation configuration, the baffle board forms both an air flow channel and a roof-wall plate opening block. In order to install the baffle board of Eury, it is thus necessary to fold the board along multiple lines. It is further necessary for the installer to exercise judgment regarding the proper positioning of the baffle board (compare FIGS. 4 and 5 of Eury, which illustrate that an installer would be required to judge both the proper spacing of the baffle board from the underside of the roof deck and the proper angle of the baffle board relative to the roof).

There is a need for a vent baffle that is inexpensively manufactured, effectively provides ventilation and insulation baffling, is quickly and easily installed, and that may be installed in a wide range of building configurations. The present invention satisfies this need.

BRIEF SUMMARY OF THE INVENTION

Briefly stated, in a first aspect the present application is directed to an adaptable vent baffle mountable to an underside of a roof and to a wall plate of a building structure between a pair of roof rafters having a rafter spacing for permitting ventilation between a soffit and an attic space of the building structure. The vent baffle includes a main body portion having a longitudinal axis and being positioned generally on a main body plane. A spacer extends generally perpendicularly from the main body relative to the main body plane and a tail portion is hingedly mounted to the main body portion. The main body portion and tail portion include first and second side edges extending generally parallel to the longitudinal axis. A baffle width is defined between the first and second side edges. At least one line of weakness extends generally parallel to the longitudinal axis for modifying the baffle width to adapt to the rafter spacing.

In another aspect, the present application is directed to a perforating machine for forming at least one perforated line on a polymeric sheet part having an indexing projection. The perforating machine includes a working table including a generally planar upper surface, an input end, an outlet end and a feed axis. A feed mechanism includes a feed component in releasable contact with the indexing projection to move the sheet part generally parallel to the feed axis between the input end and the outlet end. A drive mechanism drives the feed mechanism and at least one tool forms at least one line of weakness on the sheet part as the sheet part moves along the feed axis.

In a further aspect, the present application is directed to a perforating machine for forming a plurality of perforation lines in a polymeric vent baffle sheet having at least one spacer extending from a first face and at least one side stiffener extending from a side surface of the at least one spacer. The perforating machine includes a working table including a feed axis, an inlet end and an outlet end. A feed belt includes teeth positioned a predetermined height from a working face of the working table. The teeth are in contact with the at least one side stiffener for moving the vent baffle sheet generally parallel to the feed axis from the inlet end to the outlet end. At least one perforating wheel is in contact with a surface of the vent baffle sheet to form at least one perforation line on the vent baffle sheet as the vent baffle sheet moves from the inlet end to the outlet end.

BRIEF DESCRIPTION OF THE SEVERAL VIEWS OF THE DRAWINGS

The following detailed description of preferred embodiments of the invention will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
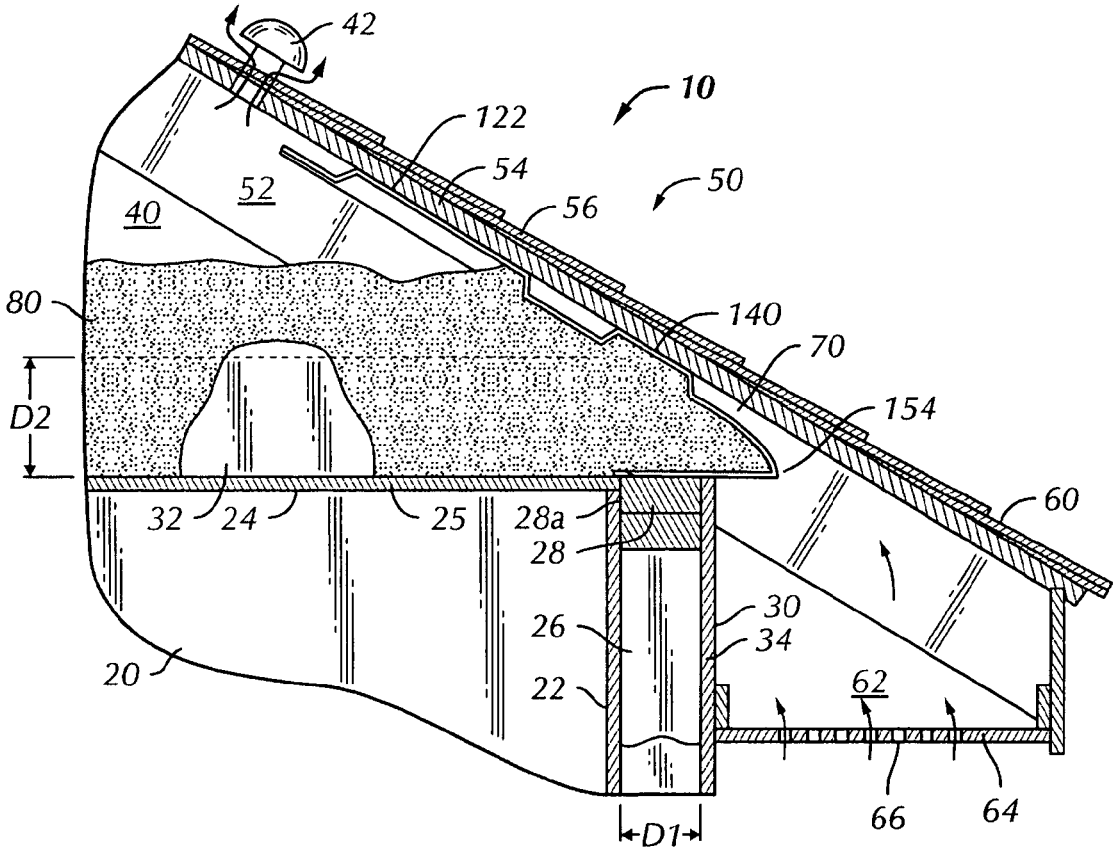
FIG. 1 is a cross-sectional view through a roof, wall and ceiling of a building structure, showing a vent baffle in accordance with one preferred embodiment of the present invention in an installed configuration to block a roof-wall plate opening of a first size.

Certain terminology is used in the following description for convenience only and is not limiting. The words "right", "left", "top", and "bottom" designate directions in the drawings to which reference is made. The words "interior" and "exterior" refer to directions towards and away from, respectively, the geometric center of the vent baffle or designated parts thereof. Furthermore, as used herein, the word "a" or a singular component includes the plural or more than one component, unless specifically and explicitly restricted to the singular or a single component or unless a singular meaning is apparent from the context. The terminology includes the words above specifically mentioned, derivatives thereof and words of similar meaning.

Referring to the drawings, wherein like reference numerals are used to designate the same components throughout the figures, there is shown in FIGS. 1-7 two preferred, non-limiting embodiments of a vent baffle 100. The vent baffle 100 is attachable to an underside of a roof deck 54 and to a wall plate 28 of a building structure 10.

Figure 2:
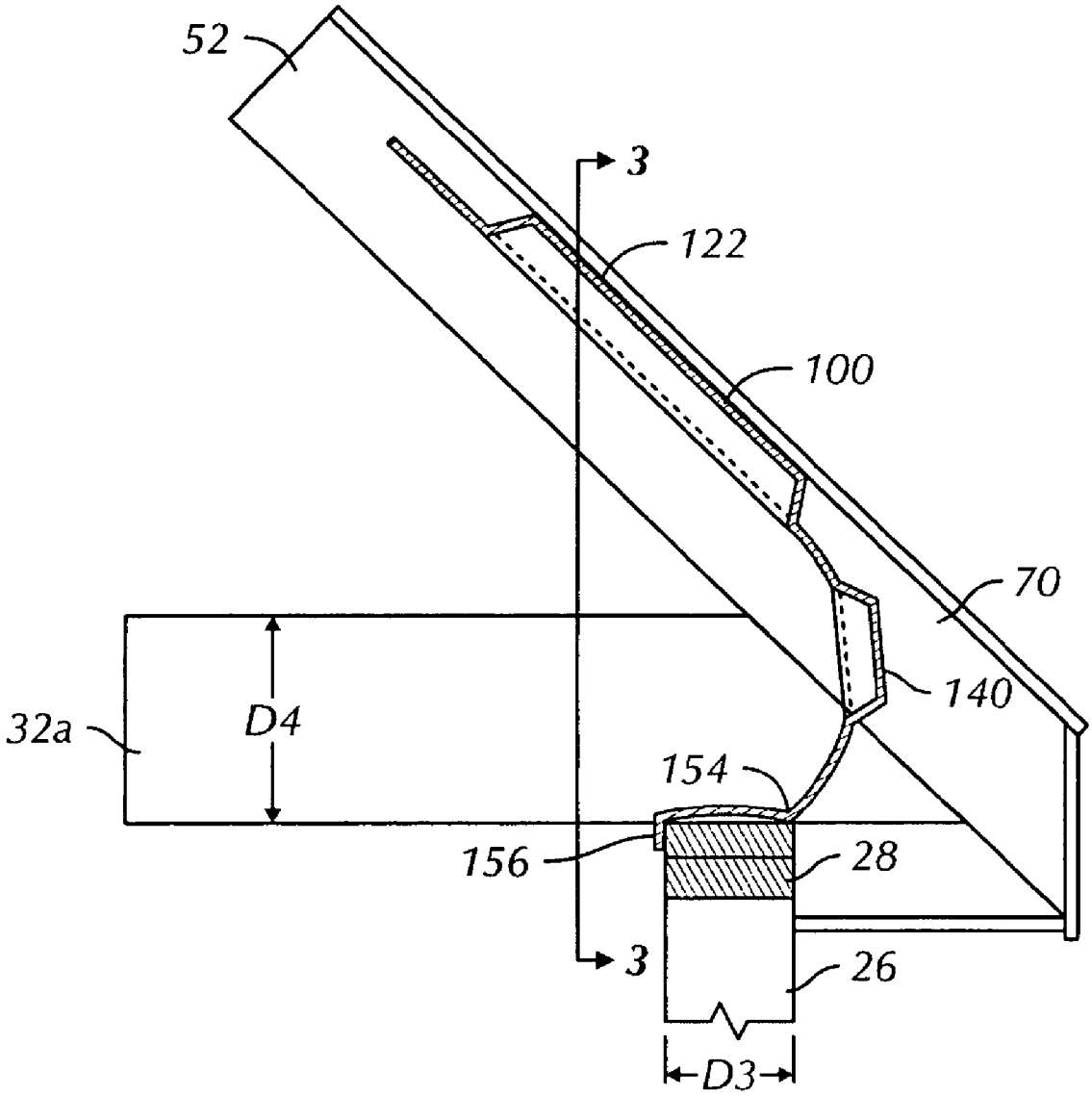
FIG. 2 is a cross-sectional view through a roof, wall and ceiling of a building structure, showing the vent baffle of FIG. 1 in an installed configuration to block a roof-wall plate opening of a second size.
Figure 3:
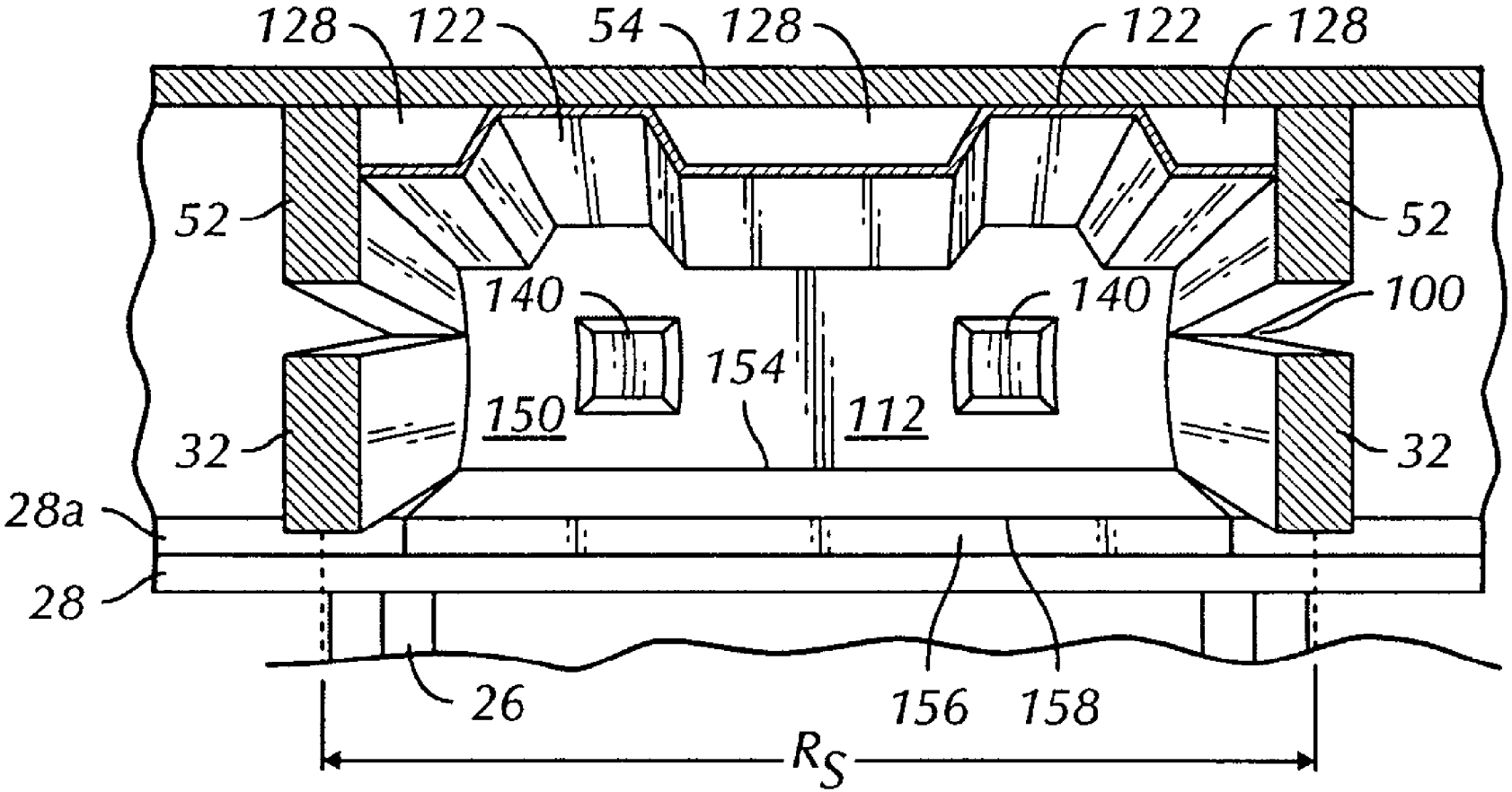
FIG. 3 is an interior perspective view of the vent baffle of FIGS. 1 and 2, oriented toward an exterior of the building structure and taken along line 3-3 of FIG. 2.

With particular reference to FIGS. 1-3, the building structure 10 is of conventional construction, and includes an interior room 20, an attic space 40, and a roof structure 50. The interior room 20 has an exterior wall 30 preferably formed by an assembly of interior wall board 22, wall studs 26 and an exterior wall covering 34 (a variety of well-known conventional materials including wood, vinyl or brick may be used for the exterior wall covering 34). The exterior wall 30 separates the interior room 20 from the outdoors 12. The wall plate 28 forms a top portion of the exterior wall 30. The interior room 20 further includes a ceiling 24 formed by ceiling wall boards 25 attached to ceiling joists 32. The ceiling joists 32 also function as attic floor joists. Typically, insulation 80 is installed over the ceiling 24 to insulate the interior room 20 of the building structure 10.

The roof structure 50 includes the roof deck 54 attached to roof rafters 52. Shingles 56 are attached to the roof deck 54. The roof rafters 52 and ceiling joists 32 may be supplied as a pre-assembled roof truss assembly or alternatively may be assembled at the construction site. The roof structure 50 preferably includes eaves 60 extending beyond the exterior wall 30. The eaves 60 include an interior space 62 and an underside, or "soffit" 64. The eave interior space 62 is vented to the outdoors 12 by soffit vents 66.

Sets of the roof rafters 52 and ceiling joists 32 connect together with the wall plate 28 and the roof rafters 52 typically have a rafter spacing $R_s$ of two feet (2') between adjacent sets of roof rafters 52 and ceiling joists 32. The roof-wall plate opening 70 is formed between adjacent sets of roof rafters 52 and ceiling joists 32. This roof-wall plate opening 70 may vary in size, depending upon size of the ceiling joists 32, size of the roof rafters 52, the rafter spacing $R_s$ of the ceiling joists 32 and roof rafters 52 (typically twenty-four inches (24")) and arrangement of the connection between the ceiling joists and roof rafters. For example, a ceiling joist 32 having a first height D2 is illustrated in FIG. 1, while a ceiling joist 32*a* having a height D4 (larger than D2) is illustrated in FIG. 2. The roof-wall plate opening 70 corresponding to ceiling joist 32 is smaller than the roof-wall plate opening 70 corresponding to ceiling joist 32*a*. Note further that the width of the wall plate 28 may vary, with the wall plate 28 (and wall studs 26) having a first width D1 (for example, D1 corresponding to the width of conventional two by four inch (2×4") lumber) (FIG. 1) or having a second width D3 (for example, D3 corresponding to the width of conventional two by six inch (2×6") lumber) (FIG. 2). Furthermore, the pitch of the roof 50 may vary from one building structure 10 to another.

As discussed above, it is desirable to provide ventilation from the outdoors 12, through the soffit vents 66, into the eave interior space 62, through the roof-wall plate opening 70 and into the attic space 40, as depicted by the directional arrows in FIG. 1. The attic 40 may be provided with a passive or motor-driven fan vent 42 to increase and/or control the rate of ventilation flow.

With reference now primarily to FIGS. 1-6, the vent baffle 100 comprises a single-piece, unitary body, having a first face 110 and a second face 112. The vent baffle 100 preferably has a first end 102, a second end 104, a first side edge 106 and a second side edge 108. A central longitudinal axis 101 extends between the first and second ends 102, 104. The first and second side edges 106, 108 preferably extend generally parallel to the longitudinal axis 101 and the first and second ends 102, 104 are preferably positioned generally perpendicular to the longitudinal axis 101, but are not so limited. A main body portion 120 is proximate the first end 102 and has a main body plane 120*a*. At least one and, preferably, two elongated end spacers 122 extend generally perpendicularly from the first face 110 of the main body 120 relative to the main body plane 120*a*. Preferably, the end spacers 122 are closer to the first end 102 than the second end 104. A tail portion 150 is connected to the main body portion 120, and is proximate the second end 104. Preferably, the tail portion 150 is movably connected to the main body portion 120 by a single flexible hinge 154. As described in detail below, when the vent baffle 100 is installed in the building structure 10, it is necessary, for the embodiment of the vent baffle 100 shown in FIGS. 1-6, that the installer bend the vent baffle 100 along this single hinge 154.

Figure 6:
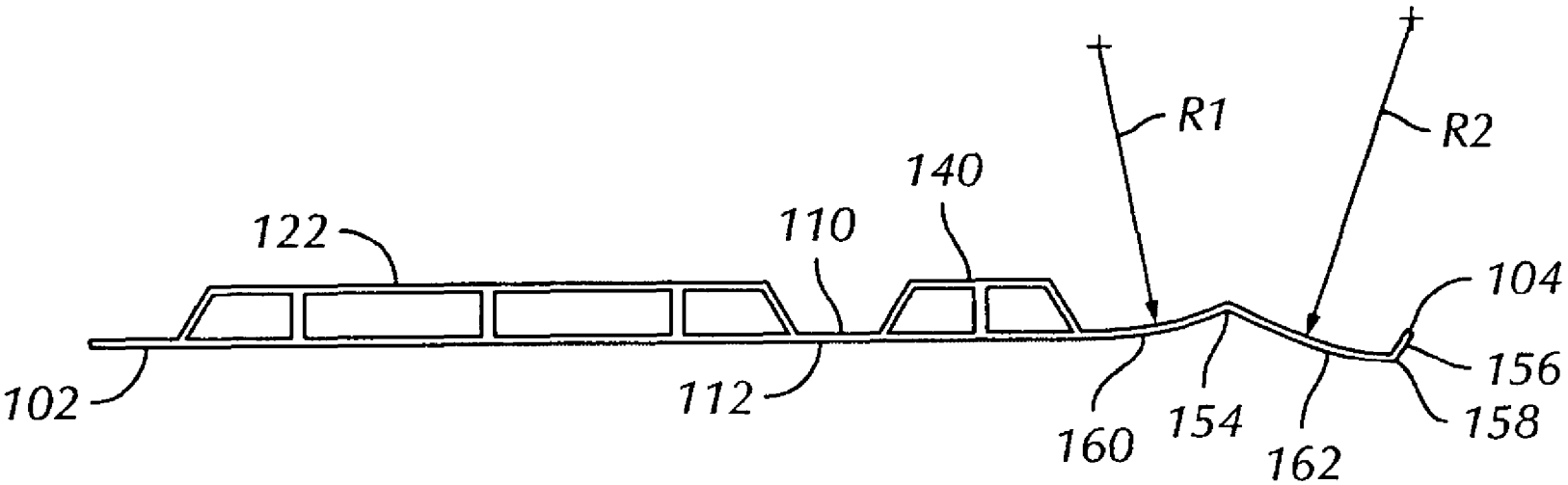
FIG. 6 is a side elevational view of the vent baffle of FIG. 4.

In one preferred embodiment, the hinge 154 is formed by an intersection of two preformed radiused sections 160 and 162. More particularly, as is best illustrated in FIG. 6, an end of the main body portion 120 extending toward the second end 104 includes a first radiused section 160, formed along a radius R1 located with respect to the side of the vent baffle corresponding to the first face 110. A second radiused section 162 extending between the first radiused section 160 and the second end 104 follows a radius R2 also located with respect to the first face 110 side of the vent baffle 100. The hinge 154 is not scored, cut or perforated. The vent baffle 100 has substantially the same thickness in the main body portion 120, the tail portion 150 and at the hinge 154.

Preferably, the tail portion 150 has a flange 156 disposed at the second end 104, the flange 156 being connected to a remainder of the tail portion 150 by a preferably single preformed bend 158. Preferably, the preformed bend forms an angle in the range of about 70 to about 110 degrees between the flange 156 and the remainder of the tail portion 150 (the angle being measured along the first face 110). Like the hinge 154, the bend 158 is not scored, cut or perforated and the bend 158 has substantially the same thickness as other portions of the vent baffle 100.

With particular reference to FIGS. 1-4B, the main body portion 120 is adapted to be fixedly attached to the underside of the roof deck 54 between the roof rafters 52 and ceiling joists 32, such that the end spacer 122 is positioned adjacent the underside of the roof deck 54, creating at least one air flow channel 128 between the first face 110 and the underside of the roof deck 54. In the preferred embodiment, having two end spacers 122, there are three air flow channels 128 including an air flow channel 128 disposed along first and second side edges 106 and 108 of the vent baffle 100 between the spacers 122 and the roof rafters 52 and another air flow channel 128 disposed between the two end spacers 122. The vent baffle 100 preferably has a baffle width $W_B$ of approximately twenty-two and one-half inches (22½") such that the first and second side edges 106, 108 abut or are in close proximity to the roof rafters 52 in an installed position. The first and second side edges 106, 108 preferably abut or are in close proximity to the roof rafters 52 to generally prevent gaps that preferably prevent insulation 80 from escaping out of the attic space 40 through the gaps or for wind to disturb the insulation in the attic space 40 by blowing through the gaps. Furthermore, the flange 156 is adapted to be fixedly attached to the wall plate 28, preferably along an interior side 28*a* of the wall plate 28 to further stabilize the vent baffle 100 and generally prevent the insulation 80 from being disturbed by airflow.

The main body portion 120 may further comprise at least one, and preferably two, intermediate spacers 140 disposed between the end spacers 122 and the tail portion 150. Like the end spacers 122, the intermediate spacers 140 extend in the first direction from the first face 110. When the vent baffle 100 is installed in a first installation configuration as shown in FIG. 1, wherein the roof-wall plate opening 70 is relative small, without the tail portion 150 sagging inwardly away from the roof deck 54, the intermediate spacers 140 enhance the function of the end spacers 122 by bearing against the underside of the roof deck 54. In some installations, the intermediate spacers 140 may act as stiffeners in the direction of the longitudinal axis 101 of the vent baffle 100. In such installations, the intermediate spacers 140 tend to force the vent baffle 100 into a "bowed out" second installed configuration as shown in FIG. 2 when the vent baffle 100 is installed in a building structure 10 having a relatively large roof-wall plate opening 70. Thus, the intermediate spacers 140 tend to position the vent baffle 100 into the desired installed position, irrespective of the particular dimensions of the roof-wall plate opening 70 of the building structure 10.

Figure 4:
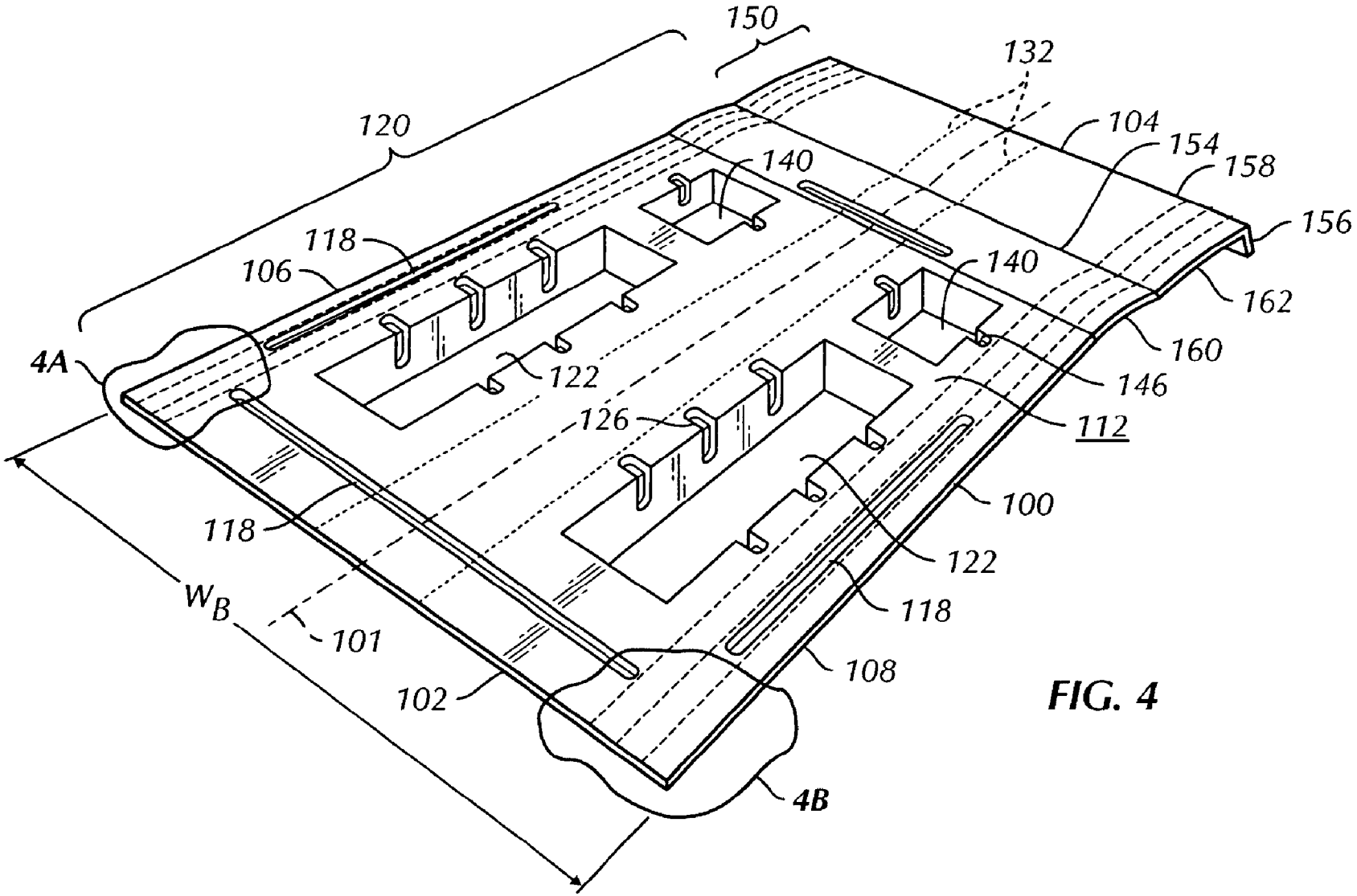
FIG. 4 is a perspective view of a first face of the vent baffle of FIGS. 1 and 2, shown in an uninstalled configuration.
Figure 4A:
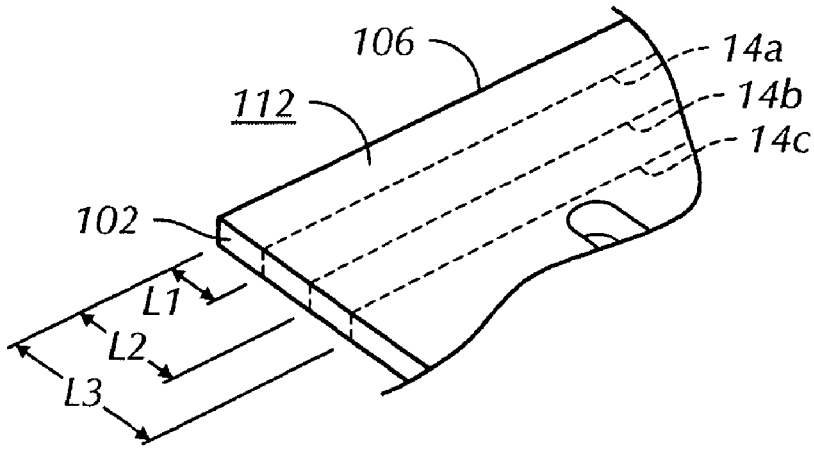
FIG. 4A is a greatly magnified perspective view of the vent baffle taken from the circle 4A of FIG. 4 showing perforated lines at a corner portion of the vent baffle.
Figure 4B:
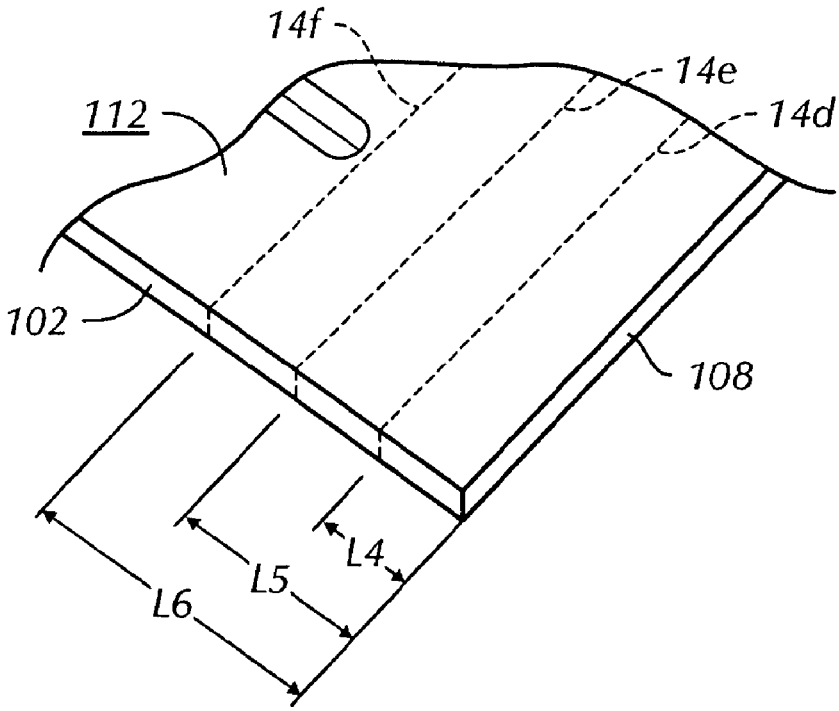
FIG. 4B is a greatly magnified perspective view of the vent baffle taken from the circle 4B of FIG. 4 showing perforated lines at a corner portion of the vent baffle.
Figure 5:
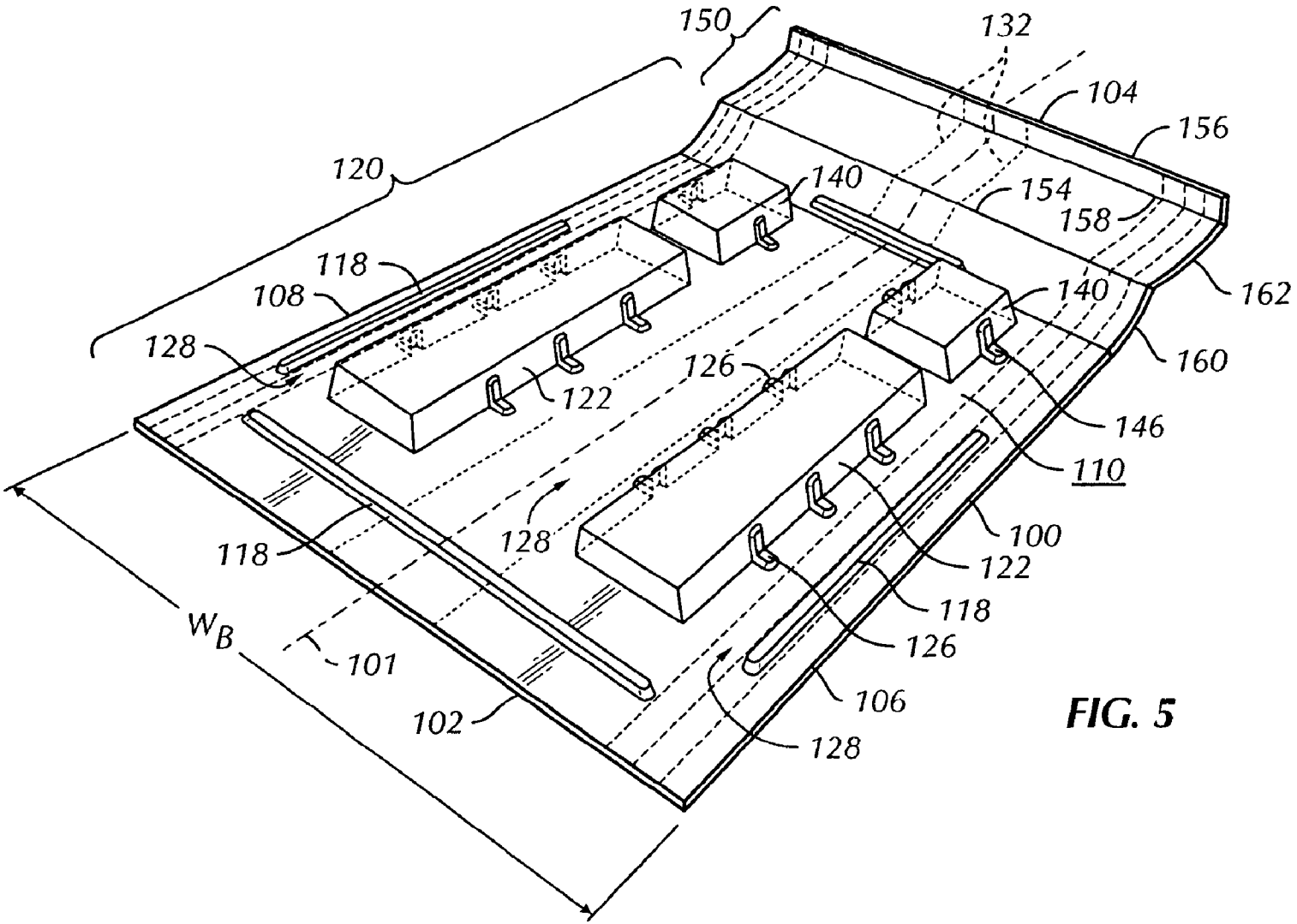
FIG. 5 is a perspective view of a second face of the vent baffle of FIG. 4.
Figure 7:
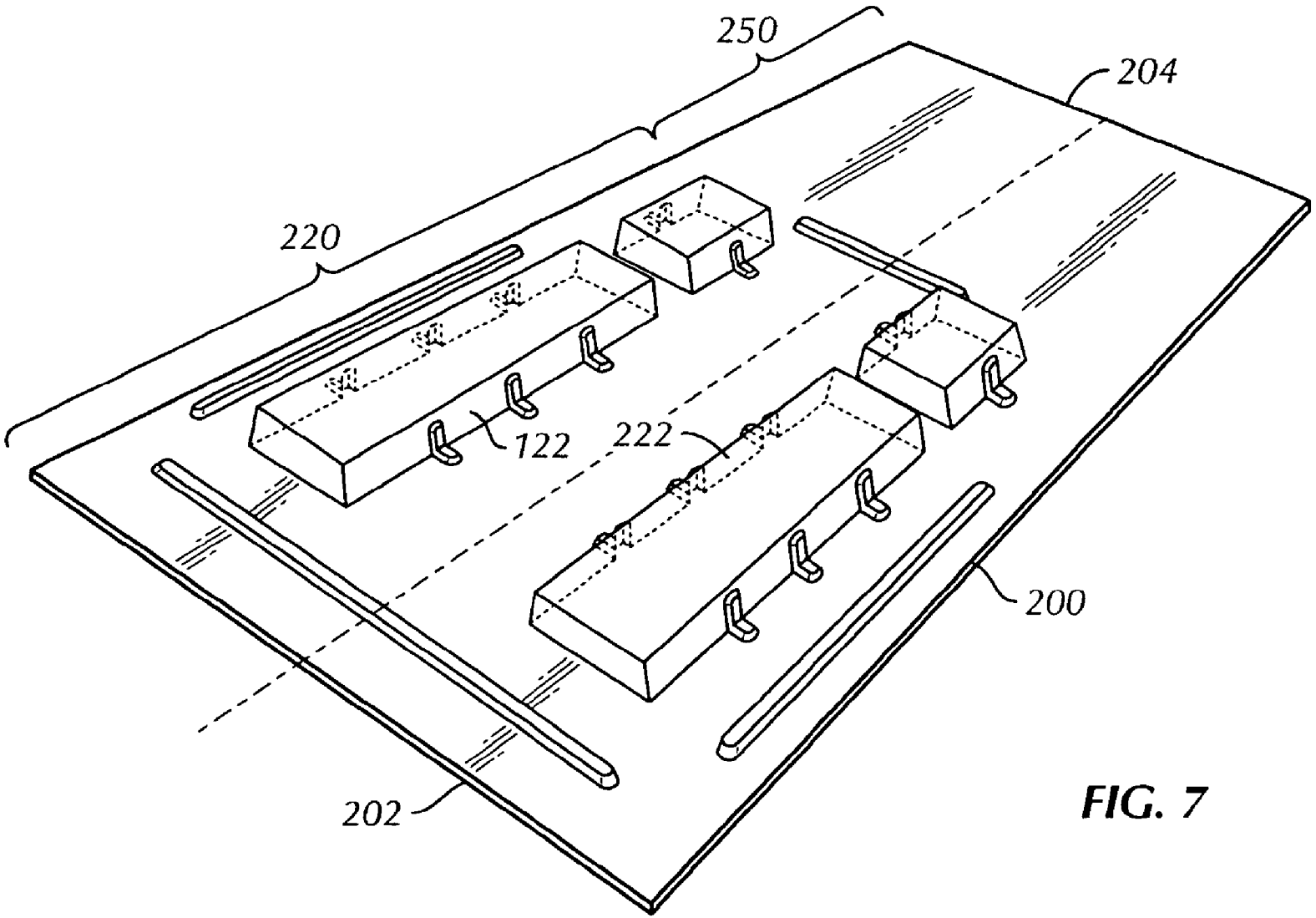
FIG. 7 is a perspective view of another embodiment of the present invention, shown in an uninstalled configuration.

An edge stiffener 118, shown only in the embodiments illustrated in FIGS. 4, 5 and 7, optionally, but preferably, may be disposed along at least one of the first end 102 and portions of the two side edges 106, 108, and is preferably disposed along each of the first end 102 and portions of the side edges 106, 108 proximate the first end 102. Similarly, the end spacers 122 and intermediate spacers 140 may further comprise at least one, and preferably a plurality, of side stiffeners 126, 146, respectively. In the preferred embodiment, the side stiffeners 126, 146 are formed unitarily with the end and intermediate spacers 122, 140, respectively, by conventional thermal forming or molding techniques.

The vent baffle 100 is a flexible sheet preferably having a thickness of about 0.010 inch to about 0.040 inch. Sheet metals, thermoplastics, and composite materials composed of fibers impregnated with thermoplastic materials can all be used to form the vent baffle 100. Sheet metals such as galvanized steel, stainless steel, aluminum and copper can be formed into vent baffles for use in the present invention. Thermoplastic materials which can be used in the present invention are, for example, polyvinyl chlorides (plasticized or unplasticized), polystyrenes, acetals, nylons, acrylonitrile-butadiene-styrene (ABS), styrene-acrylonitrile (SAN), polyphenylene oxides, polycarbonates, polyether sulfones, polyaryl sulfones, polyethylene, polystyrene, terephthalates, polyetherketones, polypropylenes, polysilicones, polyphenylene sulfides, polyionomers, polyepoxides, polyvinylidene halides, and derivatives and/or mixtures thereof. The particular material used is dependent upon the desired end use and the application conditions associated with that use, as is well known in the art. Presently it is preferred that a synthetic polymer, such as polyvinylchloride, polypropylene, ABS, or polystyrene, be used to form the vent baffle 100.

The vent baffle 100 is preferably fabricated using conventional thermal forming techniques well known in the art of molding. From this disclosure, the artisan will recognize that the geometrical design of the vent baffle 100 allows a simple one-step manufacturing process, reducing the cost of fabrication. The artisan will further recognize from this disclosure that multiple vent baffles 100 may be stacked on top of one another in a nested arrangement for storage and shipment, facilitating transport of the vent baffles 100.

Referring to FIGS. 3-5, the vent baffle 100 may be provided with at least one line of weakness 132, 14*a*-14*f* extending over at least a portion of the main body 120 to facilitate cutting and/or tearing the vent baffle 100 into smaller portions for installation between adjacent sets of roof rafters 52 and ceiling joists 32 having less than the two foot (2') standard spacing or to adapt the vent baffle for insertion between roof rafters 52 having nearly any atypical rafter spacing $R_S$. Specifically, in the preferred embodiment, the vent baffle 100 includes one or more score lines 132 (best seen in FIG. 4) extending generally parallel to the longitudinal axis 101 near a middle portion of the vent baffle 100 for cutting the vent baffle 100 into two portions. In addition, the preferred vent baffle 100 includes perforated lines 14*a*-14*f* extending generally parallel to the longitudinal axis 101 proximate the first and second side edges 106, 108 for tearing the vent baffle 100 to modify the baffle width $W_B$. The score lines 132 and perforated lines 14*a*-14*f* preferably extend from the first end 102 to the second end 104 generally parallel to the longitudinal axis 101, but are not so limited. For example, the score lines 132 or perforated lines 14*a*-14*f* may extend at an angle to the longitudinal axis 101 to adapt to roof rafters 52 that taper at they extend toward a peak of the building structure 10 or may extend along nearly any path on the vent baffle 100 to accommodate specific features of the building structure 10 and rafters 52 or joists 32.

Referring to FIGS. 4-5, the perforated lines 14*a*-14 are preferably comprised of a first perforated line 14*a*, a second perforated line 14*b*, a third perforated line 14*c*, a fourth perforated line 14*d*, a fifth perforated line 14*e* and a sixth perforated line 14*f* that extend across the vent baffle 100 generally parallel to the longitudinal axis 101 and the first and second side edges 106, 108. The first, second and third perforated lines 14*a*, 14*b*, 14*c* are preferably positioned at first, second and third distances L1, L2, L3 from the first side edge 106 and the fourth, fifth and sixth perforated lines 14*d*, 14*e*, 14*f* are preferably positioned at fourth, fifth and sixth distances L4, L5, L6 from the second side edge 108. In the preferred embodiment, the first distance L1 is three-quarters of an inch (¾"), the second distance L2 is two and one-quarter inches (2¼"), the third distance L3 is four inches (4"), the fourth distance L4 is one-half inch (½"), the fifth distance L5 is three inches (3") and the sixth distance L6 is four inches (4"). The baffle width $W_B$ and first, second, third, fourth, fifth and sixth distances L1-L6 are not limited to the above-listed values and may take on nearly any value that permits adapting the vent baffle 100 for a particular building structure 10 or alternate application. The vent baffle 100 may be torn along one or more of the perforated lines 14*a*-14*f* to modify the baffle width $W_B$ to adapt the vent baffle 100 for various rafter spacings $R_S$.

In use, the vent baffle 100 of the present invention is installed to the underside of the roof deck 54 and to the wall plate 28 in several steps. In a first step the user provides a vent baffle 100 and positions the vent baffle 100 such that the spacer 122 is adjacent the underside of the roof deck 54 between adjacent roof rafters 52. When the spacer 122 is positioned adjacent the underside of the roof deck 54 at least one air flow channel 128 is created between the underside of the roof deck 54 and the first face 110. A portion of the tail portion 150 is positioned adjacent the wall plate 28 and the tail portion 150 may be angled relative to the main body portion 120 at the hinge 154 such that the vent baffle 100 substantially blocks the roof-wall plate opening 70. This forms the baffle for channeling air flow from the soffit vents 66 into the attic space 40, while also retaining the insulation 80 within the attic space 40 such that the insulation 80 does not block the air flow. The vent baffle 100 may be readily placed in the proper position for installation, irrespective of the exact dimensions of the building structure 10 into which the vent baffle 100 is being installed. More particularly, with reference again to FIGS. 1-3, it is not necessary that the installer gauge the position of the vent baffle 100 relative to the underside of the roof deck 54 in order to obtain an air flow channel 128 of the appropriate size. That is, the spacer 122 automatically positions the first face 110 at the proper distance from the underside of the roof deck 54.

Similarly, the flange 156 and hinge 154 aid in properly placing the vent baffle 100 relative to the wall plate 28 and roof deck 54. More particularly, when the flange 156 overlaps a portion of the interior side of the wall plate 28*a*, and the second radiused portion 162 is positioned adjacent a top of the wall plate 28, the main body portion 120 tends to position itself relative to the roof deck 54 and wall plate 28 in the proper position along the longitudinal axis 101 of the vent baffle 100, such that a full layer of insulation 80 can be installed over the entire ceiling 24. Accordingly, only minimal effort is required on the part of the installer to properly place the vent baffle 100 into the installation position.

Depending upon the rafter spacing $R_S$, the vent baffle 100 may be directly inserted between the rafters 52 such that the first and second side edges 106, 108 abut or are in close proximity to the rafters 52. However, if the rafter spacing $R_S$ is atypical or the vent baffle 100 is being positioned between two end rafters (not shown) where the rafter spacing $R_S$ may be greater or less than for the remainder of the building structure 10, the baffle width $W_B$ may be modified by cutting or tearing the vent baffle 100 along one or more of the score lines 132 or the perforated lines 14*a*-14*f*. For example, if the rafter spacing $R_S$ of rafters 52 having a one and one-half inch (1½") thickness is sixteen inches (16"), the third and sixth perforated lines 14*c*, 14*f* are torn by a user resulting in a vent baffle 100 having a baffle width $W_B$ of fourteen and one-half inches (14½") that may be inserted between the two adjacent rafters 52 such that the first and second side edges 106, 108 are abutting or in close proximity to the rafters 52. In addition, for a building structure 10 having a standard two foot (2') rafter spacing $R_S$, the vent baffle 100 having the twenty-two and one-half (22½") baffle width $W_B$ may be inserted directly between the rafters 52 without tearing or cutting the vent baffle 100. Further, at an end of a building structure 10 wherein a rafter spacing $R_S$ is one foot (1'), the vent baffle 100 may be cut along one of the score lines 132 resulting in a vent baffle 100 having a single spacer 122 and the creation of two air flow channels 128 between the spacer 122 and the rafters 52 when the vent baffle 100 is inserted into the end rafters 52 of the building structure 10. This vent baffle 100 would preferably have a baffle width $W_B$ of approximately ten and one-half inches (10½"). In addition, multiple vent baffles 100 or portions of the vent baffles 100 may be adapted for insertion side-by-side between roof rafters 52 having a rafter spacing $R_S$ that is larger than the baffle width $W_B$.

In another step, the tail portion 150 is preferably first secured to the wall plate 28 followed by the main body portion 120 being secured to the underside of the roof 54. Alternatively, the main body portion 120 could be secured to the underside of the roof 54 prior to the tail portion 150 being secured to the wall plate 28. Preferably, the main body portion 120 and the flange 156 are fixedly attached to the roof deck 54 and the interior side 28*a* of the wall plate 28, respectively, preferably using staples. Other mechanical fasteners or adhesive could also be used to attach the main body portion 120 and/or the flange 156.

Once the vent baffles 100 are installed, insulation 80 can then be installed in the attic space 40. Insulation 80 typically can be installed as batts laid between the ceiling joists 32 or by blowing loose insulation into the attic space 40. Blown-in insulation 80 is illustrated in FIG. 1. The ability to easily modify the baffle width $W_B$ of the vent baffle 100 when utilizing blown-in insulation 80 is preferred such that the first and second side edges 106, 108 are positioned in an abutting relationship or in close proximity to the adjacent rafters 52 such that the blown-in insulation 80 does not escape from the roof-wall plate opening 70 or wind does not blow in through the opening 70 to disturb the insulation 80.

With reference now to FIG. 7, another embodiment vent baffle 200 is similar to the first embodiment vent baffle 100 with the exception that the intermediate spacers 140, the hinge 154 and the flange 156 are omitted. The second embodiment vent baffle 200 functions in generally the same manner as the first embodiment 100 and may be manufactured using the same materials and manufacturing techniques. When installed, a main body portion 220 is not angled relative to a tail portion 250 in an abrupt manner at a hinge, but rather the tail portion 250 is an extension or continuation of the main body portion 220. The tail portion 250 is connected near a second end 204 to the wall plate 28. Although not shown in FIG. 7, the vent baffle 200 of the second preferred embodiment may also includes lines of weakness 132, 14*a*-14*f* to permit modification of the baffle width $W_B$ to adapt the vent baffle 200 to various building structures 10.

Referring to FIGS. 4, 4A, 4B and 8-11, in a preferred embodiment, the present application is further directed to a perforating machine 82 for forming at least one perforated line 14*a*-14*f* on the vent baffle 100. The preferred perforating machine 82 may be utilized to form lines of weakness 132, 14*a*-14*f* on nearly any polymeric sheet part as would be understood by one having ordinary skill in the art after reviewing the below disclosure, however, the perforating machine 82 is described herein as forming the perforated lines 14*a*-14*f* on the vent baffle 100, but is not so limited as it and may be adapted to insert or form perforated lines 14*a*-14*f* on nearly any polymeric sheet part or any sheet part that is adaptable for receipt of the perforated lines 14*a*-14*f*. In the preferred embodiment, the side stiffeners 126, 146 on the end spacers 122 or intermediate spacers 140 of the vent baffle 100 comprise indexing projections 126, 146.

The perforating machine 82 includes a working table 84 including a generally planar upper surface 84*a*, an input end 84*b*, an outlet end 84*c* and a feed access 85. Referring to FIGS. 4, 5 and 8-11, the perforating machine 82 also includes a feed mechanism 86 comprised of a feed component 88 in releasable contact with the side stiffeners 126, 146 to move the vent baffle 100 generally parallel to the feed axis 85 between the input end 84*b* and the outlet end 84*c*. In the preferred embodiment, the feed mechanism 86 includes a belt 90 and the feed component 88 is comprised of teeth 88 extending from the belt 90. The teeth 88 contact the side stiffeners 126, 146 of the intermediate spacers 122, 140 to move the vent baffle 100 generally parallel to the feed axis 85. The feed mechanism 88 is not limited to inclusion of the belt 90 and the feed component 88 is not limited to being comprised of the teeth 88 to move the vent baffle 100 generally parallel to the feed axis 85. For example, the feed mechanism 86 may be comprised of a robot (not shown) and the feed component 88 may be comprised of a suction cup on the robot that engages the vent baffle 100 to move the vent baffle 100 generally parallel to the feed axis 85 of the perforating machine 82.

In a preferred embodiment, the feed mechanism 86 further includes a drive wheel 92 mounted on a drive shaft 93 and a follower wheel 94 mounted on a follower shaft 95. The belt 90 is preferably wrapped around the drive wheel 92 and the follower wheel 94 for rotating the belt 90 generally parallel to the feed axis 85.

A drive mechanism or motor 96 preferably drives the feed mechanism 86. In the preferred embodiment, the motor 96 is in communication with the drive shaft 93 through a belt or chain 96*a*. The motor 96 preferably drives the belt or chain 96*a*, which drives the drive shaft 93 through a gear 93*a* fixed to an end of the drive shaft 93.

In the preferred embodiment, the drive wheel 92 is comprised of a pair of drive wheels 92 fixed to the drive shaft 93 and the follower wheel 94 is comprised of a pair of follower wheels 92 fixed to the follower shaft 95. Accordingly, the belt 90 is preferably comprised of a pair of belts 90 that wrap around the drive and follower wheels 92, 94 such that the belts 90 move in a direction generally parallel to the feed axis 85. The drive and follower wheels 92, 94 and belts 90 are preferably spaced such that the teeth 88 engage the inner side stiffeners 126, 146 on the end spacers 122 and intermediate spacers 140. The drive and follower wheels 92, 94 and belts 90 are not limited to being spaced for engagement of the inner side stiffeners 126, 146 and may be spaced to engage the outer stiffeners 126, 146 or nearly any combination of the stiffeners 126, 146. In addition, the feed mechanism 86 is not limited to the inclusion of two drive and follower wheels 92, 94 and two belts 90 and may include nearly any number of belts and/or wheels for feeding the vent baffle 100 or nearly any polymeric sheet part generally parallel to the feed axis 85.

In the preferred embodiment, the motor 96 is an electric motor selected to have the ability to drive the belt 96*a* and drive gear 93*a* for driving a series of vent baffles 100 connected end to end 102, 104 along the feed axis 85. The drive motor 96 is not limited to electric motors and may comprise nearly any mechanism that is able to drive the drive shaft 93 or the vent baffle 100 along the feed axis 85 including, for example, a hydraulic motor, a gasoline engine or a linear actuator.

Referring to FIGS. 4 and 8-12, the perforating machine 82 further includes at least one tool 98 for forming the perforated lines 14*a*-14*f* on the vent baffle 100 as the vent baffle 100 moves along the feed axis 85. In the preferred embodiment, the at least one tool 98 is comprised of a perforating wheel 98 that is in contact with the vent baffle 100 as the vent baffle 100 moves along the feed axis 85. The perforating wheel 98 preferably includes a series of perforating teeth 98*a* spaced along its periphery that engage and puncture the vent baffle 100, preferably at generally uniform intervals as the vent baffle 100 moves along the feed axis 85. The perforating wheel 98 is preferably mounted within a wheel housing 99. As the vent baffle 100 moves along the feed axis 85, the perforating wheel 98 rotates under the driving force of the moving vent baffle 100 causing the perforating teeth 98*a* to engage and puncture the vent baffle 100 and form the perforated lines 14*a*-14*f*. In the preferred embodiment, six perforating wheels 98 located within six wheel housings 99 are mounted to a support beam 48*a* above the working table 84 to form the six perforated lines 14*a*-14*f* on the vent baffle 100. Six perforating wheels 98 are preferably mounted to the support beam 48 at positions relative to the working table 84 to form the above-described perforated lines 14*a*-14*f* spaced at the above-described distances L1-L6.

In the preferred embodiment, the perforating machine 82 further includes a backstop wheel 72 rotatably mounted on an opposite side of the working table 84 relative to the perforating wheels 98. In addition, the working table 84 preferably includes a hole 74 therein that the backstop wheel 72 at least partially extends into or through such that the perforating wheels 98 and the backstop wheel 72 are in engagement through the hole 74. The backstop wheel 72 is preferably mounted to a rotatable backstop shaft 73 beneath the working table 84. The backstop wheel 72 is preferably comprised of a pair of backstop wheels 72 fixably mounted to the backstop shaft 73 such that a least a portion of the backstop wheels 72 extend into or through the holes 74. The backstop shaft 73 and the backstop wheels 72 are preferably freely rotatable and rotate based upon the driving of the vent baffle 100 as it moves along the feed axis 85. The backstop shaft 73 and backstop wheels 72 are not limited to being freely rotatable and may be driven by a drive mechanism, for example, the motor 96 or a separate motor (not shown) to aid in driving the vent baffle 100 along the feed axis 85. The backstop wheels 72 preferably provide a backstop that the perforating wheels 98 contact during operation to prevent the vent baffle 100 from flexing within the hole 74, such that the vent baffle 100 is generally uniformly cut or perforated by the perforating wheels 98. In addition, the backstop wheels 72 generally result in a more even and consistent perforated line 14*a*-14*f* on the vent baffle 100. The perforating machine 82 is not limited to the inclusion of the backstop wheels 72 or the backstop shaft 73 and the perforating wheels 98 may contact and perforate the vent baffle 100 against the working table 84 during operation.

Figure 10:
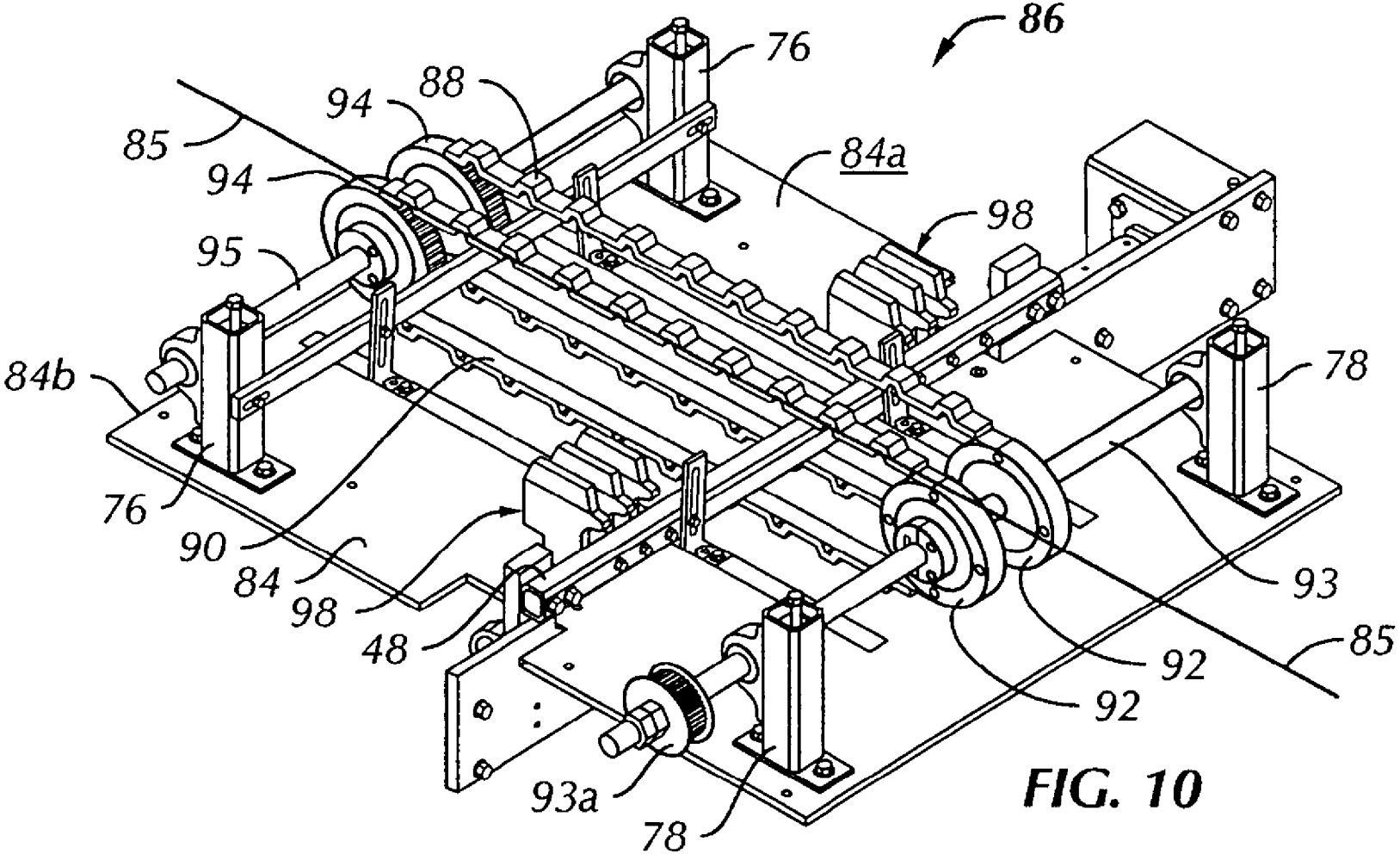
FIG. 10 is a top perspective view of a feed mechanism and a perforating mechanism of the perforating machine of FIG. 8.
Figure 11:
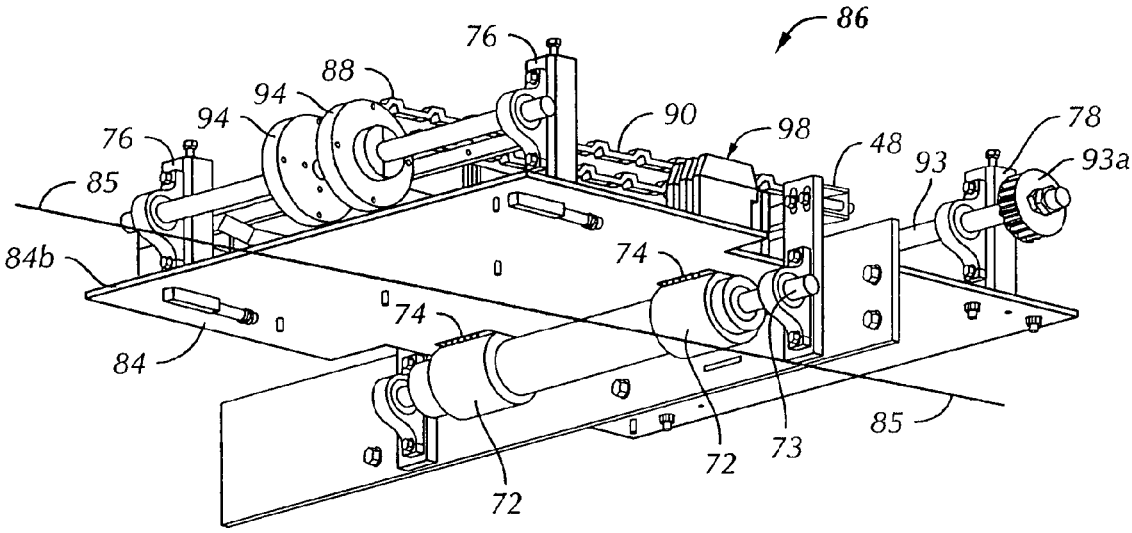
FIG. 11 is a bottom perspective view of the feed and perforating mechanisms of the perforating machine of FIG. 8.
Figure 12:
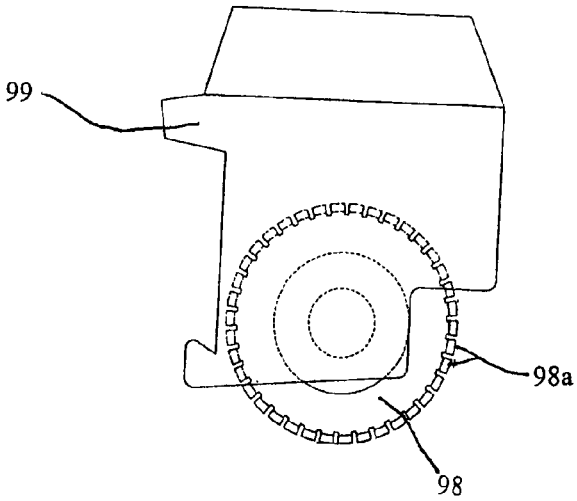
FIG. 12 is a side elevational view of a perforating wheel of the perforating machine of FIG. 8.

Referring to FIGS. 10 and 11, in the preferred embodiment, the feed mechanism 86 further includes a pair of follower towers 76 and a pair of drive towers 78 extending generally perpendicularly from the upper surface 84*a* of the working table 84 that rotatably support the follower shaft 95 and drive shaft 93, respectively. The follower and drive towers 76, 78 preferably position the follower shaft 98 and drive shaft 93 at a predetermined height above the working table 84 such that the teeth 88 on the belt 90 properly engage the side stiffeners 126, 146 on the vent baffle 100. Proper distancing of the teeth 88 relative to the working table 84 is preferred such that the teeth 88 consistently engage the side stiffeners 126, 146 to move the vent baffle 100 across the working table 84 generally parallel to the feed axis 85.

Figure 8:
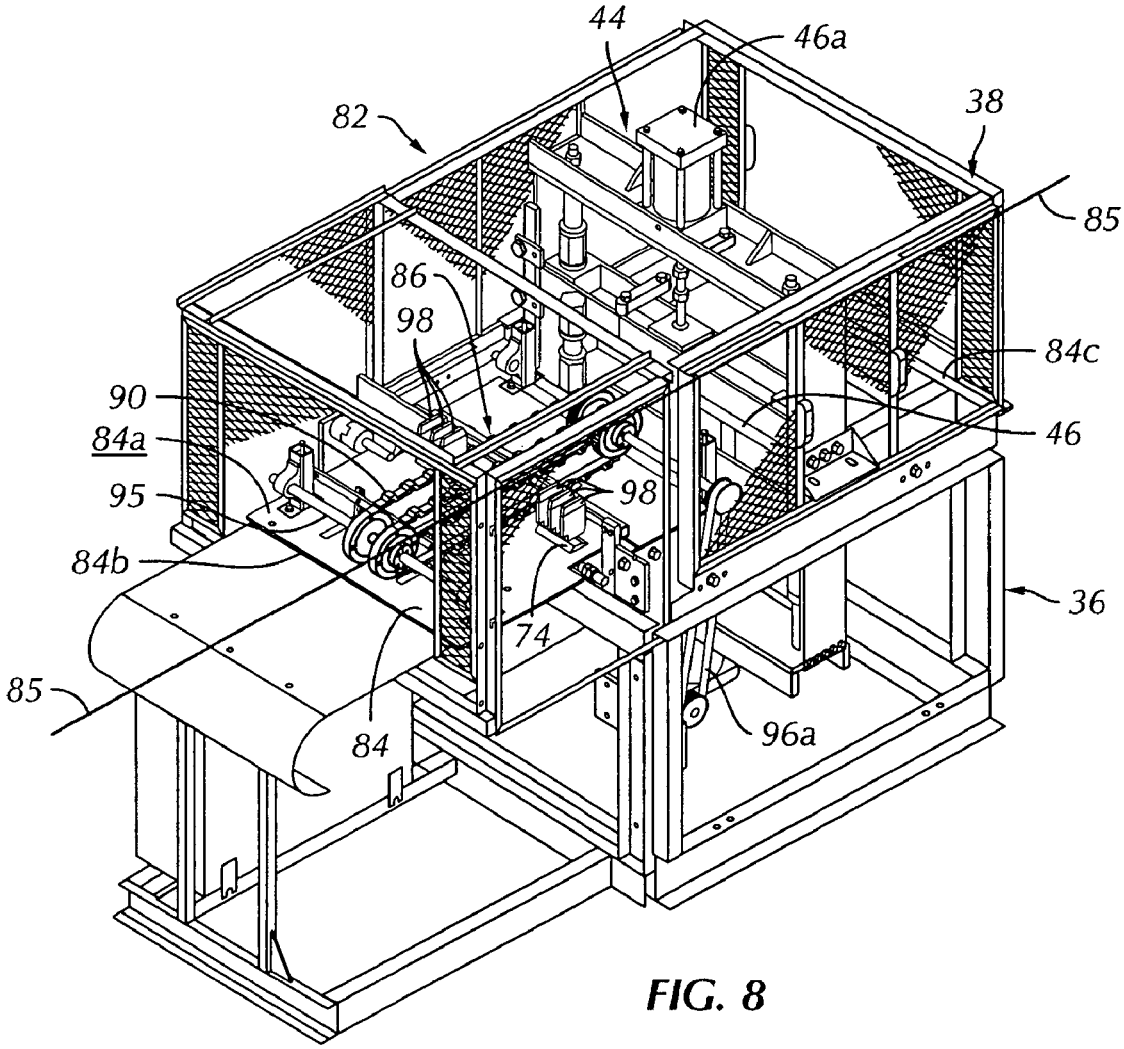
FIG. 8 is a top perspective view of a perforating machine in accordance with a preferred embodiment of the present invention.
Figure 9:
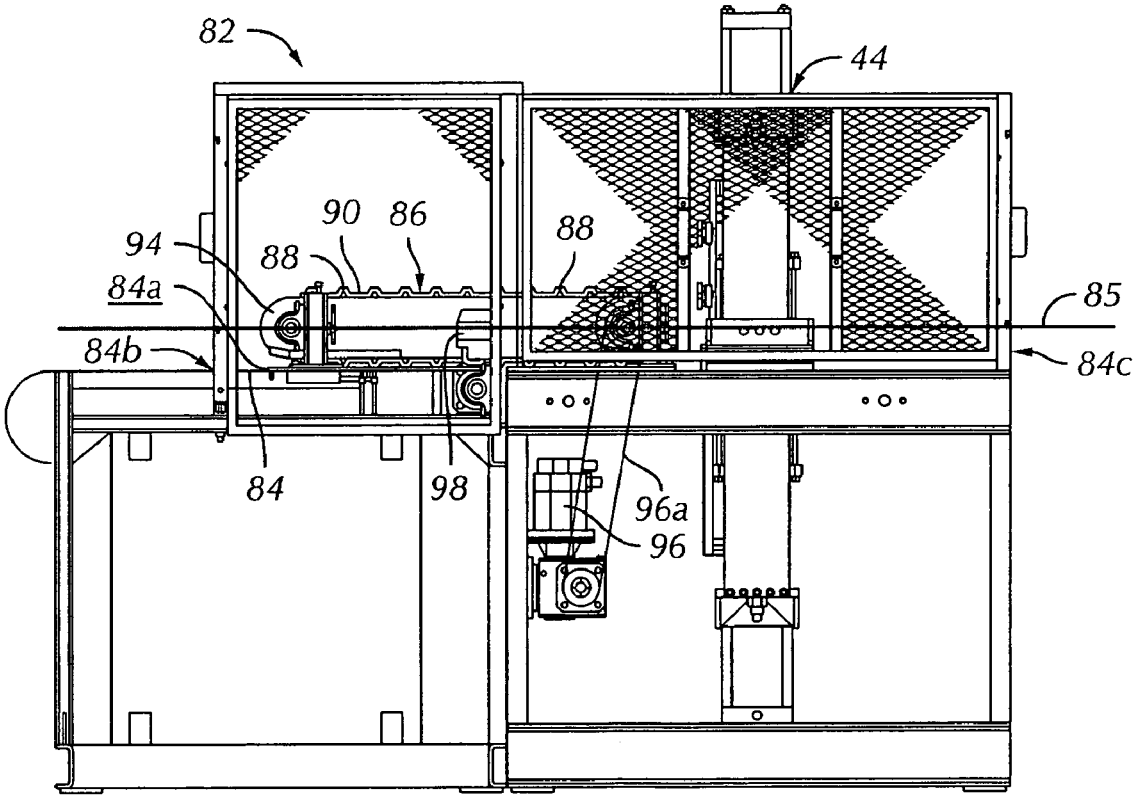
FIG. 9 is a right-side elevational view of the perforating machine of FIG. 8.

Referring to FIGS. 8 and 9, in the preferred embodiment, the perforating machine 82 includes an end sheer assembly 44 including a cutting blade 46 mounted to the working table 84 for sheering the series of vent baffles 100 to separate individual vent baffles 100. The perforating machine 82 is preferably part of an assembly line wherein a series of vent baffles 100 are connected end to end as they may be formed in a thermoforming operation on a continuous sheet of material and are moved along the feed axis 85 from the inlet end 84*b* to the outlet end 84*c*. When an abutment of two vent baffle sheets 100 are positioned beneath the cutting blade 46 of the end sheer assembly 44, the cutting blade 46 is actuated to cut the one vent baffle 100 from a trailing second vent baffle 100 at the first and second ends 102, 104, respectively. Specifically, the cutting blade 46 is actuated by a pneumatic cylinder 46*a* of the end sheer assembly 44 toward the working table 84 to sheer one vent baffle 100 from the other vent baffle 100. Accordingly, the series of vent baffles 100 connected end to end may be continuously feed through the perforating machine 82 to form the perforated lines 14*a*-14*f* thereon and to separate the vent baffles 100. The cutting blade 46 is not limited to being actuated or driven by the pneumatic cylinder 46*a* and may be actuated or driven by a motor, linear actuator, gravity, spring, hydraulic cylinder or other like mechanism that is able to drive or move the cutting blade from a raised to a cutting position to separate vent baffles 100 as they travel down an assembly line.

Referring to FIGS. 4A, 4B, 5 and 8-11, in operation, vent baffles 100 connected end to end 102, 104 are fed into the perforating machine 82 at the inlet end 84*b*. Certain of the side stiffeners 126, 146 are engaged by the teeth 88 of the belt 90 to move the connected vent baffles 100 along the feed axis 85 toward the outlet end 84*c*. Specifically, the motor 96 is actuated to drive the belt 96*a*, which drives the gear 93*a*, which drives the drive shaft 93 and the drive wheels 92. The drive wheels 92 cause the belts 90 to rotate about the follower wheels 94 in a continuous motion such that the connected vent baffles 100 are moved across the working table 84 generally parallel to the feed axis 85. As the connected vent baffles 100 move across the working table 84, a surface of the vent baffles 100 moves between the perforating wheels 98 and the backstop wheels 72 such that the perforated lines 14*a*-14*f* are formed in the vent baffles at the above-described distances L1-L6. The distances L1-L6 may be readily modified by moving the perforating wheels 98 relative to the working table 84 to change the position of the perforated lines 14*a*-14*f* on the surface of the vent baffle 100. When an abutment of the vent baffles 100 reaches the end sheer assembly 44, the pneumatic cylinder 46*a* is actuated to urge the cutting blade 46 toward the working table 84 to separate a leading vent baffle 100 from the following connected vent baffles 100. The separated vent baffle 100 is then either urged or manually moved off of the working table 84 from the outlet end 84*c* for storage.

The perforating machine 82 is preferably supported by a support structure 36 off of an assembly floor and is preferably enclosed by a safety cage 38 to typically prevent workers or for foreign objects from coming into contact with moving parts of the perforating machine 82 to increase safety and prevent damage to the perforating machine 82, respectively. The perforating machine 82 is not limited to being mounted off of the floor on the support structure 36 or to the inclusion of the safety cage 38. However, the support structure 36 and safety cage 38 are preferred for convenience and safety reasons as would be apparent to one having ordinary skill in the art in view of the present disclosure.

From the foregoing it can be seen that the present invention comprises a vent baffle 100 that is inexpensively manufactured, effectively provides ventilation and insulation baffling, is quickly and easily installed, and that may be installed in a wide range of building configurations. It can also be seen that the present application describes a perforating machine that is able to form lines of weakness on a sheet part such that the sheet part is adaptable to various widths. It will be appreciated by those skilled in the art that changes could be made to the embodiments described above without departing from the broad inventive concept thereof. It is understood, therefore, that this invention is not limited to the particular embodiments disclosed, but is intended to cover modifications within the spirit and scope of the appended claims.

We claim:

1. A perforating machine for forming a plurality of perforation lines in a polymeric vent baffle sheet having first and second opposing ends with at least one spacer extending from a first face of said polymeric vent baffle intermediate said first and second ends, said spacer including a plurality of side stiffeners projecting outwardly from a side surface of the at least one spacer, the perforating machine comprising:

a working table including a feed axis, an inlet end and an outlet end;

an endless feed belt including teeth projecting outwardly, the endless feed belt having an upper belt portion and a lower belt portion, the lower belt portion positioned a predetermined height above a working face of the working table, the teeth in the lower belt portion being in contact with said side stiffeners for moving the vent baffle sheet generally parallel to the feed axis from the inlet end to the outlet end;

a first plurality of perforating wheels and a second plurality of perforating wheels in contact with a surface of the vent baffle sheet to form perforation lines on the vent baffle sheet while the vent baffle sheet moves from the inlet end to the outlet end;

a pair of follower towers extending generally perpendicularly from the working table proximate the inlet end, the pair of follower towers rotatably supporting a follower shaft and a follower wheel, the follower shaft and follower wheel spaced from the working table;

a pair of drive towers extending generally perpendicularly from the working table proximate the outlet end, the pair of drive towers rotatably supporting a drive shaft and a drive wheel, the drive shaft and drive wheel spaced from the working table, the first plurality of perforating wheels and the second plurality of perforating wheels being positioned between the follower towers and the drive towers so that the teeth of the endless feed belt are engaged with the side stiffeners in said vent baffle sheet when the perforating wheels engage the vent baffle sheet to form the perforation lines;

a first backstop wheel and a second backstop wheel mounted to a backstop shaft on an opposite side of the working table from the perforating wheels; a first hole and a second hole in the working table proximate the first and second backstop wheels such that the first plurality of perforating wheels are in engagement with the first backstop wheel through the first hole and the second plurality of perforating wheels are in engagement with the second backstop wheel through the second hole; and wherein the endless feed belt is wrapped around the drive wheel and the follower wheel.

* * * * *